US005164050A

United States Patent [19]

Bertaud et al.

[11] Patent Number: 5,164,050

[45] Date of Patent: Nov. 17, 1992

[54] METHOD OF OBTAINING URANIUM FROM OXIDE USING A CHLORIDE PROCESS

[75] Inventors: Yves Bertaud, Voiron; Jean Boutin, Argenteuil; Pierre Brun, Grenoble; Roger Durand, Le Vesinet; Antoine Floreancig, La Murette; Airy-Pierre Lamaze, Grenoble; Roland Tricot, Chambourcy, all of France

[73] Assignee: Compagnie Europeenne du Zirconium Cezus, Courbevoie, France

[21] Appl. No.: 547,186

[22] Filed: Jul. 3, 1990

[30] Foreign Application Priority Data

Jul. 6, 1989 [FR] France ..... 89 09454

[51] Int. Cl.[5] ..... C25C 3/34

[52] U.S. Cl. ..... 204/1.5; 423/3; 423/19; 423/253; 423/257

[58] Field of Search ..... 423/3, 19, 253, 257; 252/626, 627, 643; 420/3; 204/1.5; 75/398, 399

[56] References Cited

U.S. PATENT DOCUMENTS

| | | | |
|---|---|---|---|
| H659 | 8/1989 | Haas | 204/1.5 |
| H857 | 12/1990 | Haas | 204/1.5 |
| 2,867,501 | 6/1959 | Hanley | 423/5 |
| 2,890,099 | 6/1956 | Rhodes et al. | 423/5 |
| 3,895,097 | 7/1975 | Langenhoff et al. | 423/341 |
| 4,188,266 | 2/1980 | Forman | 204/1 R |
| 4,214,956 | 7/1980 | Bowman | 204/67 |
| 4,217,181 | 8/1980 | Gurr | 204/1.5 |
| 4,222,826 | 9/1980 | Riggs, Jr. et al. | 204/1.5 |
| 4,225,396 | 9/1980 | Graham et al. | 204/1.5 |
| 4,234,393 | 11/1980 | Hepworth et al. | 204/1.5 |
| 4,297,174 | 8/1981 | Brambilla et al. | 204/1.5 |
| 4,853,094 | 8/1989 | Honders et al. | 204/64 R |
| 4,913,884 | 4/1990 | Feuling | 423/9 |

OTHER PUBLICATIONS

Merritt, Robert C., "The Extractive Metallurgy of Uranium, 1971."

*Primary Examiner*—Donald P. Walsh
*Assistant Examiner*—Daniel J. Jenkins
*Attorney, Agent, or Firm*—Dennison, Meserole, Pollack & Scheiner

[57] ABSTRACT

A method of obtaining uranium metal from an oxidized uranium compound, characterized in that the oxidized compound is treated with chlorine and carbon at a first stage, to obtain a chloride which is reduced by electrolysis or metallothermy using a reducing metal at a second stage.

30 Claims, No Drawings

METHOD OF OBTAINING URANIUM FROM OXIDE USING A CHLORIDE PROCESS

TECHNICAL FIELD

The invention concerns a method of obtaining uranium metal by steps from an oxide compound such as $UO_3$ or $U_3O_8$, using a chloride process.

STATE OF THE ART

The normal way of producing uranium metal from an oxide, generally $UO_3$, is to use a method which successively comprises reduction to $UO_2$ at high temperature, using hydrogen or a hydrogen vector gas such as $NH_3$, followed by fluoridation with hydrofluoric acid at high temperature or in aqueous phase to obtain $UF_4$, and metallothermic reduction, e.g. by Mg or Ca. This gives uranium in ingots and a by-product which is a fluoride (e.g. of Mg or Ca) and which has to be decontaminated before being disposed of.

Although this method is commonly used it has some drawbacks. In particular it involves using hydrofluoric acid, which is both dangerous—and hence very difficult to handle—and expensive, and a reducing agent such as Mg or Ca which are also costly. Moreover these two costly products (fluorine and reducing agent) end up as a by-product in the form of an alkaline earth metal fluoride; this requires decontamination by an expensive moist process which itself generates liquid effluents. Moreover the decontamination, which is necessary to eliminate and recover the uranium content, leaves some traces of uranium, which limit any chances of upgrading the fluoride.

Thus Applicants sought to perfect a process which would avoid the use of expensive and particularly dangerous products such as hydrofluoric acid and the formation of a by-product which would be equally costly to treat and eliminate. They were also looking for a process which would preferably be continuous and unaffected by the presence of impurities in the initial oxide, or which would preferably purify the oxide.

DESCRIPTION OF THE INVENTION

The invention is a method of producing uranium from one of its oxide compounds without creating any liquid or solid effluent, characterised by the sequence of the following stages:

(1) reacting a mixture, as such or agglomerated, of a powder of said oxide compound and an excess of carbon powder with chlorine gas at a temperature over 600° C., to obtain $UCl_4$ gas which is filtered and condensed after possibly being purified by distillation.

(2) reducing $UCl_4$ at a high temperature below the melting temperature of uranium, so as to produce uranium in solid form and one of its by products, and (3) recycling the by-product to the process, possibly after converting it to an elemental form in which it can be recycled.

The reduction is generally:

either electrolysis in the dry way, preferably in a medium of melted alkali metal or alkaline earth metal chlorides, to obtain firstly solid uranium, and secondly chlorine in elemental form, which is recycled direct to the first stage.

or metallo thermic reduction with at least one metallic reducing agent such as Mg, Ca, Na or K; this gives firstly solid uranium and secondly chlorine in metal chloride form. The by-product is converted to elemental form for recycling, that is to say, it is converted to its constituent elements which are also recycled: chlorine to the first stage and the metal to reduction (en reduction). The constituent elements are generally obtained or separated by electrolysis.

It will be seen that the method only uses cheap products (C), that the other reagents are recycled, and that it does not produce any solid or liquid effluent. The only gas effluent produced is $CO/CO_2$ which can easily be filtered before disposal. Such a process provides big gains in manufacturing costs: there is no treatment for disposal of solid effluent, and installations are simplified due to the absence of $F_2$ and HF.

In accordance with the invention the starting product is any pure or impure oxidised uranium compound, for example an oxide such as $UO_2$, $U_3O_8$, $UO_3$, $UO_4$ or a mixture thereof, usually $U_3O_8$ or more commonly $UO_3$, or a uranate, preferably ammonium diuranate since the presence of alkali metals or alkaline earth metals is not always desirable. The initial uranium-containing compound, preferably in dry, divided form (powder, scale, granulate, etc.) is mixed with carbon (coke, coal, graphite etc.) also in divided form. The mixture, either as such or possibly after granulation or agglomeration, is fed into a high temperature reactor, where it reacts with chlorine gas. The chlorine gas may or may not be diluted with an inert gas such as argon, helium or nitrogen, preferably introduced counter currently when the operation is continuous and/or so that it percolates through the charge.

With $UO_3$ the reaction generally produces $UCl_4$, as follows: $UO_3+3C+2\ Cl_2 \rightarrow UCl_4+3\ CO$ (and/or $CO_2$), but $UCl_5$ and $UCl_6$ may also be formed. The operation takes place at a high temperature of about 600° C. and preferably from 900° to 1100° C., to obtain preferably $UCl_4$ and to limit the formation of $UCl_5$ or $UCl_6$, and at any pressure; for practical reasons, however, it is easier to use a pressure close to atmospheric. The proportion of CO and/or $CO_2$ obtained depends on the reaction temperature.

There is a complete reaction. It is preferable to operate with an excess of at least 5% by weight of carbon, to avoid the formation of oxychlorides and to obtain $UCl_4$ in gaseous form.

The quantity of $Cl_2$ used is at least sufficient to use up all the uranium; a slight excess is favourable but must be limited to avoid the formation of higher chlorides $UCl_5$ and $UCl_6$. The reaction may be carried out in many different ways. It is possible, for example, to operate in a medium of melted salt such as alkali metal chlorides which do not react with the reagents used. The salt bath is then fed regularly with the mixture of the oxidised uranium compound and carbon, and chlorine is bubbled through. Such a process is particularly important when the initial uranium compound is an impure concentrate, particularly if it contains troublesome elements such as alkali metals or alkaline earth metals, rare earths or others. The bath containing $UCl_4$ may possibly be used for electrolysis, but it is preferable to recover $UCl_4$ in gas form.

It is also possible to operate in solid phase. The uranium compound, alone or preferably mixed with carbon, can then be fed directly into a reactor containing a carbon bed, providing the excess carbon. All kinds of reactor or furnace may be suitable, for example a belt-type, rotary or sliding bed furnace or the like. But the most effective is a fluidised bed reactor, containing a carbon bed fluidised by chlorine and the reaction gases, which is fed with the mixture of uranium compound and carbon compound, preferably in powder form. More generally however, the various types of reactor may equally be fed with granules, compacts, spheres etc. This type of process is important, particularly when the uranium compound contains few alkaline elements and preferably few impurities.

Sublimed $UCl_4$ obtained during the reaction is filtered at the outlet from the reactor, for example through quartz or silica fabric. If the $UCl_4$ should contain volatile impurities purification may be carried out through distillation and condensation. If such purification is not necessary the $UCl_4$ is condensed directly in solid form (snow) or liquid form, thus separating it from any $Cl_2$ which may be present and/or from dilution gases and non-condensable gases such as Ar, He, $N_2$, CO, $CO_2$ and the like.

When the $UCl_4$ contains higher chlorides such as $UCl_5$ or $UCl_6$, a dismutation operation may be carried out, comprising retrograding the higher chlorides to $UCl_4$. This operation simply comprises heating the chloride mixture, either in solid phase to a temperature of 150° to 500° C. under reduced pressure, generally of about 6 mm of mercury, or in gas phase to a temperature of at least 800° C. The chlorides may also be retrograded by electrolysis as will be explained later. The second stage then follows, comprising reduction to obtain uranium metal in any of the above embodiments.

First Embodiment: Electrolysis of $UCl_4$

Electrolysis takes place in the dry way in a melted salt medium, preferably in a bath based on chlorides, e.g. alkali metal and/or alkaline earth metal chlorides, with solid uranium being recovered at the cathode and chlorine liberated at the anode. NaCl or a mixture of NaCl+KCl is generally used. Although a bath containing fluorides only would be possible, it is not recommended since it tends to stabilise the presence of oxyflorides; these are difficult to reduce without greatly increasing the oxygen content of the metal deposited.

The composition of the bath solution may vary widely. It is generally arranged so that the melted bath has a low $UCl_4$ vapour tension, and so that the temperature corresponds to the desired morphological structure of the uranium deposit at the cathode. The crystalline morphology and the quality of the cathode deposit in fact depend largely on the temperature at which it is formed, the chemical constitution of the bath and the concentration of $UCl_4$ and/or $UCl_3$ therein.

The mean uranium content of the electrolyte is very variable. It is generally over about 2% by weight (expressed in U) to give an adequate diffusion speed, and less than about 25% by weight to avoid excessive separation of $UCl_4$ in vapour phase; a content of from 5 to 12% by weight is satisfactory. $UCl_4$ is introduced in solid, liquid or gas form.

It is nevertheless important to add a limited quantity of a fluoride, generally an alkali metal fluoride such as NaF or KF, in order to stablise the IV valency of the uranium chloride. If this is not added $UCl_3$ is found to form, and its presence affects deposition at the cathode. The appropriate F:U molar ratio is generally below 6:1, and the weight of alkali metal fluoride in the bath is generally from 2.5 to 5%. The electrolysis temperature is about 25° C. to 100° C. above the melting point of the selected bath solution. The operation generally takes place at from 650° to 850° C. and preferably from 650° to 750° C. The current density is adapted to the composition of the bath solution and is generally below 0.8 $A/cm^2$ and preferably below 0.2 $A/cm^2$; otherwise fine particles of uranium form and may drop to the bottom of the tank with the mud, where they are dangerous as they are so easily oxidisied.

Normally:

the electrolysis tank is metallic and is fitted with a heating means to facilitate its operation and with electric corrosion protection (protection cathodique)

the anode unit comprises at least one anode made of carbon material such as graphite or a metal which cannot be corroded by the bath solution or chlorine, and is fitted with a device for collecting the $Cl_2$ liberated.

the cathode unit comprises at least one metal cathode, made e.g. of uranium, steel or other metal so that the uranium deposited can easily be detached.

It is desirable to arrange a diaphragm between the anode and cathode to prevent the elements from recombining and to facilitate the collection of chlorine. It must be sufficiently porous (10 to 60% of voids, preferably 20 to 40%) and is made of a material which is heat resistant and resistant to corrosion of the bath solution. It is preferable to use a conductive material, e.g. a metal or preferably a graphite containing material, which can be polarised cathodically to prevent any migration of uranium to the anode and reformation of chloride. Metal may be deposited on the diaphragm, tending to block it; the metal deposit is then redissolved by depolarisation. Polarisation of the diaphragm leads to different concentrations in the anode compartment (anolyte) and the cathode compartment (catholyte).

The metal deposited on the cathode must adhere well enough not to drop to the bottom of the tank and be irrecoverable. On the other hand it must not adhere too well, so that it can easily be recovered. As already stated, the crystalline form of the deposit and its properties depend on a certain number of factors such as the nature of the bath, its composition, concentration and temperature, the current density etc.

The interpolar distance between electrodes is variable and depends largely on the form in which the metal is deposited. It is important to lay down the electrolytic conditions so as to avoid large outgrowths of the metal; the metal should thus be deposited in fairly compact form, though not too compact in order to facilitate its subsequent recovery. The interpolar distance is normally from 50 to 200 mm.

Once the cathode is sufficiently charged with a deposit of uranium soiled with inclusions of bath solution, it is washed and recovery of the uranium is proceeded with. This may be done by mechanical means such as scraping, machining or the like, giving a metal in divided form which is washed with acidified water and/or melted to eliminate the inclusions. Alternatively the uranium may be recovered by physical means such as melting or the like, giving a purified ingot topped by a layer of scoria emanating from the inclusions in the bath. The chlorine obtained at the anode is recycled to the preceding stage, after possible addition of fresh $Cl_2$ to compensate for losses.

There is a particularly interesting improvement of this electrolysis which makes it possible to deposit uranium metal, to proceed with electro-refining it, to retrograde higher chlorides to $UCl_4$ and to dispense with the diaphragm between the anode and cathode. It comprises:

surrounding the immersed anode at a spacing with an openwork basket made e.g. of metal plaiting (treillis) which is also immersed in the bath and forms the cathode; it may comprise two vertical coaxial cylinders defining a vertical annular space and rigidly connected to a base arranging at least one complementary immersed cathode outside the basket applying a voltage to the complementary cathode to polarise it cathodically relative to the basket feeding the electrolyte by inserting the chlorides or uranium chlorides in the basket, preferable in the annular space.

Crude uranium is then found to be deposited in the basket forming the cathode, and the higher $UCl_4$ chlorides are found to be reduced, while refined uranium is deposited on the complementary cathode or cathodes.

Second Embodiment—Metallothermic Reduction of $UCl_4$

Methods of metallothermic reduction to obtain uranium metal are well known, particularly the reduction of $UF_4$ by Mg or Ca, where the reaction products pass through a melted state. Such a process cannot be used for reducing $UCl_4$ because of the heat balances. Thus it is preferable to operate as follows, using the reaction:

$$UCl_4 + 4M \rightarrow U + 4M\ Cl$$

M represents a fusible metal which can reduce $UCl_4$ at temperatures below about 1100° C., if necessary with external energy provided. It is preferable to use Mg or Ca, but Na, K or a mixture thereof are also possible.

This stage in the method of the invention comprises reacting the liquid reducing metal contained in a reactor or closed crucible generally made of normal or stainless steel, with $UCl_4$ which is introduced steadily, generally in liquid or gas form, at a termperature and under conditions such that $UCl_4$ reacts with the reducing agent in the gas state, that the resultant chloride is liquid and that the uranium produced remains solid.

Thus it is normal to operate at from about 600° to 1100° C. and preferably from about 800° to 1000° C., in a reducing or inert atmosphere ($H_2$, He, Ar or the like), in a reactor generally made of steel, which may be heated externally, possibly with a plurality of zones kept at different temperatures. A charge of reducing metal in solid or liquid form is first placed in the crucible and the crucible is closed with a lid. The air is purged by putting it under vacuum and/or scavenging with a reducing or neutral gas. Heating is applied to bring the chamber to the chosen reaction temperature and to put the reducing metal into or keep it in liquid form. $UCl_4$ is then introduced, e.g. in gas form, and reacts with the melted reducing agent. Uranium collects at the bottom of the crucible and/or along the walls in more or less agglomerated solid form. The liquid chloride of the reducing metal and the liquid reducing metal which has not yet reacted float on the surface of the uranium in two successive layers which are classed in the order of their density; the layer of reducing agent is generally at the top and the liquid salt in contact with the uranium.

It is advantageous to draw off the liquid chloride regularly in order to increase the treatment capacity of the crucible.

At the end of the reaction there is thus a more or less compact mass of uranium, soiled by inclusions of reducing metal and of (chloride) salt formed. The unused reducing metal, and thus the excess to be expected, may be up to 20 to 30% relative to the stoichiometry of the $UCl_4$ used.

To purify the uranium obtained of these inclusions, either the crucible may be heated under vacuum to distill the reducing metl, or the uranium material may be washed with acidified water, when it has been extracted from the reactor and possibly crushed, to eliminate inclusions of the salt formed. The uranium, previously extracted from the crucible, may equally be melted, decanted and cast, either before or preferably after the excess reducing agent has been distilled off. The uranium material may be melted by methods known in the art: e.g. using an induction furnace with electron bombardment, a graphite crucible coated with a refractory material which is inert vis a vis uranium, with a cold crucible or the like. The uranium may be cast in ingot, wire, strip form of the like, using any of the methods known in the art.

The chloride of the reducing metal forming the by-product preferably undergoes electrolysis to recover the chlorine and reducing metal, which are respectively recycled to the first and second stage by methods known in the art.

The method of the invention thus avoids forming by-products or effluents which are difficult to treat and eliminate. It is economical and it produces a metal which is at least pure enough to be used particularly in a process of isotopic enrichment by laser. On the basis of a nuclearly pure oxidised uranium compound such as that obtained in classical conversion processes, the quantity obtained according to the invention is as follows:

$C < 50$ ppm
$O < 200$ ppm
$\upsilon$Fe and transition metals $< 250$ ppm
$Cl < 20$ ppm
expressed by weight relative to U the content of other impurities is less than that in the initial product.

On the basis of an impure compound, the quantity obtained is identical with the above as far as C, O, Cl, Fe and also the other impurities are concerned, provided that the first stage takes place in a melted medium, that $UCl_4$ is distilled as described, and possibly that electro-refinining is carried out, e.g. with the basket arrangement.

The quality of the uranium metal obtained can obviously be improved through purifying it by any of the methods known in the art. For example, it may be electro-refined by means of a soluble anode with an electrolyte of the type described in the first embodiment. If reduction is carried out by electrolysis (first embodiment), simultaneous electro-refining may take place by including at least one complementary electrode in the bath solution, the electrode being polarised cathodically relative to the main cathode where the crude uranium is deposited.

EXAMPLE 1

This example illustrates the first embodiment of the invention, that is to say, conversion of $UO_3$ to $UCl_4$, with the metal then being obtained by electrolysis.

first stage: obtaining $UCl_4$

The operation takes place in a verical pilot reactor made of silica glass, 50 mm in diameter and 800 mm high, fitted at the outlet with a filter of silica fabric, followed by a condenser which operates by chilling (trempe) on a water cooled wall.

A foundation of 200 $cm^3$ carbon powder is arranged at the bottom of the reactor; nuclearly pure uranium tri oxide is introduced at 600 g per hour, with carbon in an approximately stoichiometric quantity, in the form of a mixture of powders. The throughput of chlorine gas is 335 g per hour. The temperature in the reaction zone is 980° to 1000° C. and the pressure just a few millimeters of mercury above atmospheric pressure; filtration takes place at 800° C.

$UCl_4$ is obtained at 789 g per hour, containing less than 2.5% by weight of $UCl_4$ and $UCl_6$. The residual gases, $Cl_2$, CO and excess Cl, are discharged.

second stage: obtaining uranium metal through electrolysis in the dry way

The operation takes place in a stainless steel cell 800 mm in diameter, with a graphite anode 50 mm in diameter, a diaphragm made of a composite nickel/carbon material fabric with 30% porosity, a steel cathode and an interpolar space of 150 mm.

The bath solution is an equimolar NaCl-KCl mixture; it is 600 mm high for an approximate volume of 300 liters, and a concentration of uranium element of 10+2% by weight. Sufficient NaF is added to bring the molar ratio F:U to 5±1:1.

The temperature of the bath is 725° to 750° C. and the cathode current density is 0.18 A/$cm^2$. When the U content has been checked, electrolysis is carried out at 200 A and $UCl_4$ is added continuously at 400 gU/h.

20 hours later, when electrolysis has been stopped, the cathode is extracted and the uranium deposit soiled by inclusions of the bath solution is recovered mechanically.

The deposit is washed with acidified water then pure water, and 8 kg of a metallic uranium powder is recovered, in which:

7.2 kg has a particle size larger than 0.85 mm 0.8 kg has a particle size smaller than 0.85 mm The latter fraction is recovered then compacted to act as a soluble anode in an electro-refining operation.

The FARADAY cathode yield is about 90%.

The content of the fraction with a particle size larger than 0.85 mm is as follows:

C<10 ppm
$O_2$120 to 170 ppm
Fe<20 ppm
Cr<10 ppm
Ni<10 ppm
other metals<150 ppm
Cl<20 ppm

EXAMPLE 2

This example illustrates the second embodiment of the invention, that is to say, conversion of $UO_3$ to $UCl_4$ followed by reduction of $UCl_4$ by metallothermy.

First stage: obtaining $UCl_4$

This is carried out as in Example 1.

second stage:

The operation takes place in a pilot reactor formed by an AISI 304 steel tube with a diameter of 150 mm and a useful height of 250 mm, supplied with $UCl_4$ powder by a distributor. The reactor may be put under vacuum for the purifying operation; it is placed in a thermostatically controlled chamber.

2.265 kg of Mg is introduced in ingot form, and the chamber is brought to 840° to 860° C.

When the Mg has melted, about 16 kg of $UCl_4$ powder is introduced regularly for 1 hour 30 minutes. The $MgCl_2$ formed is siphoned off at regular intervals.

When all the $UCl_4$ is used up the reactor is connected to a condenser with a water cooled wall. It is put under vacuum ($10^{-2}$ to $10^{-3}$ of mercury) then heated to 930° to 950° C. This enables the excess Mg and the $MgCl_2$ still contained in the porous cake of solid U formed during reduction to be distilled and condensed by cryopumping. Virtually all the Mg (i.e. 225 g) and $MgCl_2$ (i.e. 400 g) is recovered in 5 hours.

When the reactor has cooled, a cake of good uranium metal is extracted, weighing 9.1 kg after peeling.

Analysis of the uranium cake, carried out on a plurality of samples, gives the following results:

C 20 ppm
O 150 to 200 ppm
Fe 20 to 30 ppm
Cr 20 ppm
Ni 10 to 20 ppm
Other metals: <150 ppm
Cl<20 ppm
Mg<10 ppm

We claim:

1. A method of producing uranium from one of its oxidized compounds without creating any liquid or solid effluent, comprising a sequence of the following stages:

a) reacting in a first stage a mixture of a particulate of said oxidized compound and an excess of carbon powder with chlorine gas at a temperature over 600° C., to obtain $UCl_4$ gas;

b) filtering and condensing the $UCl_4$ gas obtained;

c) reducing $UCl_4$ at a high temperature below the melting temperature of uranium, so as to produce uranium in solid form and a chlorine-containing by-product; and d) recycling the by-product to the process.

2. The method of claim 1, wherein the oxidized compound is selected from the group consisting of oxides and uranates.

3. The method of claim 2, wherein the oxidized compound is $UO_3$.

4. The method of any one of claims 1, 2, and 3, wherein there is at least 5% by weight of excess carbon.

5. The method of any one of claims 1, 2, and 3, wherein the $UCl_4$ also contains higher chlorides such as $UCl_5$ and $UCl_6$.

6. The method of any one of claims 1, 2, and 3, wherein the temperature is from about 900° to about 1100° C. at the first stage.

7. The method of any one of claims 1, 2, and 3, wherein the first stage reaction takes place in solid phase, in a fluidized carbon bed fed with said mixture of powders and with chlorine passing through it.

8. The method of any one of claims 1, 2, and 3, wherein the reduction stage is carried out through electrolysis in the dry way, in a melted bath, to obtain solid uranium at the cathode and liberation of chlorine at the anode.

9. The method of claim 8, wherein electrolysis takes place in a bath of melted chloride from a KCl-NaCl mixture.

10. The method of claim 8, wherein the U content of the bath is from 2 to 25% by weight.

11. The method of claim 8, wherein the melted bath contains a fluoride, in a molar ratio wherein F:U is less than 6:1.

12. The method of claim 8, wherein the electrolysis temperature is about 25° C. to 100° C. higher than the melting temperature of the bath, and approximately from 650° C. to 850° C.

13. The method of claim 8, wherein the uranium deposited is recovered by mechanical means.

14. The method of claim 8, wherein the chlorine recovered at the anode is recycled to the first stage.

15. The method of claim 8, wherein the U content of said bath is from 5 to 12% by weight.

16. The method of claim 9, wherein said melted bath contains a fluoride, in a molar ration wherein F:U is less than 6:1.

17. The method of claim 10, wherein said melted bath contains a fluoride, in a molar ratio wherein F:U is less than 6:1.

18. The method of claim 1, wherein the $UCl_4$ gas of step b) is purified by distillation after being filtered and condensed.

19. The method of any one of claims 1, 2, and 3, wherein the reduction stage is carried out by metallothermy, using a metallic reducing agent to give solid uranium and a chloride of said agent.

20. The method of claim 19, wherein the reducing agent is selected from the group consisting of Mg, Ca, Na, K or a mixture thereof.

21. The method of claim 20, wherein the diaphragm is of graphite containing material and is polarized.

22. The method of claim 19, wherein there is an excess of reducing agent.

23. The method of claim 19, wherein the solid uranium obtained is purified by distillation under vacuum to eliminate inclusions of reducing metal, then by washing to eliminate inclusions of the chloride formed.

24. The method of claim 19, wherein the chloride formed is electrolyzed to regenerate the chlorine and reducing agent.

25. The method of claim 24, wherein the chlorine is recycled to the first stage and the reducing agent to the second.

26. The method of claim 19, wherein the uranium obtained is subjected to fusion, decantation and casting.

27. The method of claim 19, wherein the reaction takes place between the liquid reducing agent and $UCl_4$ gas, in a closed normal steel or stainless steel reactor, the temperature being generally from about 600° to about 1100° C.

28. A method of producing uranium from one of its oxidized compounds without creating any liquid or solid effluent, comprising the steps of:

a) reacting in a first stage a mixture of particulate of said oxidized compound and an excess of carbon powder with chlorine gas in a medium of melted chlorides at a temperature over 600° C., to obtain $UCl_4$ gas;

b) filtering and condensing the $UCl_4$ gas obtained from step a);

c) reducing $UCl_4$ at a temperature below the melting temperature of uranium, so as to produce uranium in solid form and a chlorine-containing by-product; and d) recycling said by-product to the process.

29. A method of producing uranium from one of its oxidized compounds without creating any liquid or solid effluent, comprising the steps of:

a) reacting in a first stage a mixture of a particulate of said oxide compound and an excess of carbon powder with chlorine gas at a temperature over 600° C., to obtain $UCl_4$ gas;

b) filtering and condensing the $UCl_4$ gas obtained;

c) reducing the $UCl_4$ obtained from step b) by dry electrolysis at a temperature below the melting temperature of uranium, so as to produce uranium in solid form at a cathode and a by-product of chlorine at an anode, said electrolysis being carried out with a diaphragm which is arranged between the anode and cathode and is conductive;

d) recycling the by-product to the process.

30. A method of producing uranium from one of its oxidized compounds without creating any liquid or solid effluent, comprising the steps of:

a) reacting in a first stage a mixture of a particulate of said oxide compound and an excess of carbon powder with chlorine gas at a temperature over 600° C., to obtain $UCl_4$ gas;

b) filtering and condensing the $UCl_4$ gas obtained in step a);

c) reducing the $UCl_4$ obtained from step b) by dry electrolysis at a temperature below the melting temperature of uranium, so as to produce uranium in solid form at a cathode and liberation of a by-product of chlorine at an anode, said electrolysis taking place with a cathode which comprises an openwork basket surrounding the anode, and at least one complementary cathode polarized cathodically relative to said openwork basket cathode; and d) recycling said by-product to the process.

* * * * *